US008036341B2

(12) United States Patent
Lee

(10) Patent No.: US 8,036,341 B2
(45) Date of Patent: Oct. 11, 2011

(54) STATIONARY X-RAY TARGET AND METHODS FOR MANUFACTURING SAME

(75) Inventor: David S. K. Lee, Salt Lake City, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 102 days.

(21) Appl. No.: 12/191,990

(22) Filed: Aug. 14, 2008

(65) Prior Publication Data

US 2010/0040202 A1 Feb. 18, 2010

(51) Int. Cl.
*H01J 35/08* (2006.01)

(52) U.S. Cl. ..... 378/143

(58) Field of Classification Search ..... 378/143, 378/144

See application file for complete search history.

(56) References Cited

U.S. PATENT DOCUMENTS 4,461,020 A * 7/1984 Hubner et al. ..... 378/143
5,976,339 A * 11/1999 Andre, Sr. ..... 205/70
2005/0022560 A1* 2/2005 Rowe et al. ..... 65/374.12

* cited by examiner

*Primary Examiner* — Allen C. Ho

(74) *Attorney, Agent, or Firm* — Maschoff Gilmore & Israelsen

(57) ABSTRACT

Stationary x-ray target assemblies manufactured using a metal deposition process to form one or more metal layers of the target. In particular, the metal deposition process is used to form an x-ray target metal layer and/or a stress buffer zone on an x-ray target substrate. The stress buffer zone improves material properties of the metals and/or the bonding between the x-ray target metal layer and the substrate. Improved bonding between the x-ray target metal layer and the substrate also improves the heat dissipation properties of the stationary x-ray target assembly.

21 Claims, 4 Drawing Sheets

STATIONARY X-RAY TARGET AND METHODS FOR MANUFACTURING SAME

BACKGROUND

1. Field of the Invention

Embodiments of the present invention relate generally to x-ray systems, devices, and related components. More particularly, embodiments of the invention relate to x-ray target assemblies that are manufactured using a deposition process.

2. Related Technology

The x-ray tube is essential in medical diagnostic imaging, medical therapy, and various medical testing and material analysis industries. An x-ray tube typically includes a cathode assembly and an anode assembly disposed within an enclosure that is under a very high vacuum. The cathode assembly generally consists of a metallic cathode head assembly and a filament that acts as a source of electrons for generating x-rays. The anode assembly, which is generally manufactured from a refractory metal such as tungsten, includes a target surface that is oriented to receive electrons emitted by the cathode assembly.

During operation of the x-ray tube, the cathode is charged with a heating current that causes electrons to "boil" off the filament by the process of thermionic emission. An electric potential on the order of about 4 kV to over about 200 kV is applied between the cathode and the anode in order to accelerate electrons boiled off the filament toward the target surface of the anode assembly. X-rays are generated when the highly accelerated electrons strike the target.

Most of the electrons that strike the anode dissipate their energy in the form of heat. Some electrons, however, interact with the atoms that make up the target and generate x-rays. The wavelength of the x-rays produced depends in large part on the type of material used to form the anode surface. X-rays are generally produced on the anode surface through two separate phenomena. In the first, the electrons that strike the cathode carry sufficient energy to "excite" or eject electrons from the inner orbitals of the atoms that make up the target. When these excited electrons return to their ground state, they give up the excitation energy in the form of x-rays with a characteristic wavelength. In the second process, some of the electrons from the cathode interact with the atoms of the target element such that the electrons are decelerated around them. These decelerating interactions are converted into x-rays by conservation of momentum through a process called bremstrahlung. Some of the x-rays that are produced by these processes ultimately exit the x-ray tube through a window of the x-ray tube, and interact with a material sample, patient, or other object.

Stationary anode x-ray tubes employ a stationary anode assembly that maintains the anode target surface stationary with respect to the stream of electrons produced by the cathode assembly electron source. In contrast, rotating anode x-ray tubes employ a rotating anode assembly that rotates portions of the anode's target surface into and out of the stream of electrons produced by the cathode assembly electron source. The target surfaces of both stationary and rotary anode x-ray tubes are generally angled, or otherwise oriented, so as to maximize the amount of x-rays produced at the target surface that can exit the x-ray tube via a window in the x-ray tube.

In an x-ray tube device with a stationary anode, the target assembly typically consists of a disk or "button" made of a "high" Z refractory metal, such as tungsten that is suitable for generating x-rays upon impingement by the stream of highly energized electrons produced by the cathode. The target button is typically bonded or joined to a substrate made of another metal, such as copper. Heat generated in the target button by electron bombardment is typically dissipated by conduction through the substrate, which is in turn cooled by a fluid, such as water, oil, or air.

Target buttons made from tungsten and other refractory metals are typically made using a powder metallurgy process. In powder metallurgy, the metal part is manufactured by pressing a powder and then sintering the powder to form the part. The part is then heated and forged to cause densification. In many cases, the powder is densified up to 97% a theoretical density.

The substrate is subsequently joined to the target button either by casting the substrate into the button in a furnace or by brazing the target button onto a solid substrate block using a braze washer between the two materials. Such an arrangement is typical of x-ray tubes with a stationary anode, and has remained relatively unchanged in concept since its inception.

SUMMARY

Embodiments of the invention concern stationary x-ray target assemblies that are manufactured using a metal deposition process to form one or more metal layers of the target. Disclosed embodiments can be carried out on any type of x-ray target that includes metal layers made from high melting point metals, such as, but not limited to, refractory metals. The metal deposition processes of disclosed embodiments can be used to manufacture stationary x-ray targets with a unique design and/or improved material properties.

In accordance with disclosed embodiments, the deposition process used to manufacture a stationary x-ray target assembly is carried out by providing an intermediate x-ray target assembly, which is also referred to herein as a substrate. Formation of the x-ray target metal layer on at least a portion of the substrate using one or more deposition processes yields a stationary x-ray target assembly.

Suitable materials for the intermediate x-ray target assembly include, but are not limited to, Cu, Mo, Ni, Fe, Ta, Re, W, Nb, V, Ir, Rh, Pt, Pd, stainless steel, and combinations thereof Preferably, the intermediate x-ray target assembly is composed of copper. More preferably, the intermediate x-ray target assembly is composed of oxygen-free high conductivity (OFHC) copper, which is a highly purified, industrial-grade copper with excellent thermal and electrical conductive properties.

Typically, the deposition process is used to form an x-ray target metal layer that is composed of at least one refractory metal that is suitable for generating x-rays when the x-ray target metal layer is impinged by a stream of electrons. Examples of suitable metals for manufacturing an x-ray target metal layer of a stationary x-ray target assembly include, but are not limited to Cu, Mo, Ni, Fe, Ta, Re, W, Nb, V, Ir, Rh, Pt, and Pd, alone or in combination. In a disclosed embodiment, the x-ray target metal layer is composed of tungsten. In some applications, the x-ray target metal layer may optionally include at least one additional metal.

In one embodiment, the deposition process used to manufacture a stationary x-ray target assembly is used to deposit a stress buffer zone between the intermediate x-ray target assembly (i.e., the target substrate) and the x-ray target metal layer. The target substrate and the x-ray target metal layer are typically composed of different metals, and different metals typically have different coefficients of thermal expansion. This means that as the x-ray target assembly heats up as a result of electron bombardment, the x-ray target metal layer expands at a different rate than the substrate. A discontinuity in thermal expansion rates such as this can, for example, lead to debonding of the substrate and the x-ray target metal layer. Debonding can cause the x-ray target assembly to overheat and fail.

One will appreciate, therefore, that joining the x-ray target metal layer to the substrate so as to avoid a thermal expansion discontinuity is desirable. Embodiments of the present invention can minimize thermal expansion discontinuity by including a stress buffer zone that includes one or more metals between the substrate and the x-ray target metal layer. The stress buffer zone improves bonding between the substrate and the x-ray target metal layer by minimizing thermal expansion differences between adjacent metal layers fabricated from different metals.

In one embodiment, the stress buffer zone is comprised of a composite or alloy of two or more metals. In another embodiment, the composite may be a graded composite in which the relative concentrations of the two or more metals are varied across the thickness of the stress buffer zone. In yet another embodiment, the stress zone region may include alternating layers of two or more metals. In still yet another embodiment, the alternating layers may be made with varying thicknesses such that the layers composed of target material become progressively thicker towards the x-ray target metal layer, while the layers of the substrate material are thickest near the substrate and progressively thinner toward the x-ray target metal layer.

In a disclosed embodiment, the stationary x-ray target assembly includes copper and tungsten. Typically, the substrate is fabricated from copper, the x-ray target metal layer is fabricated from tungsten, and a stress buffer zone between the substrate and the x-ray target metal layer is comprised of a composite of copper and tungsten. Optionally, the copper content is varied through at least a portion of the stress buffer zone. The stress buffer zone is useful for improving the bonding between the substrate and the x-ray target metal layer because tungsten and copper have significantly different coefficients of thermal expansion (tungsten: $4.3E^{-6}/°$ C., copper: $16.5E^{-6}/°$ C.). That is, forming a stress buffer zone composed of a composite of copper and tungsten smoothes the transition between the copper substrate and the tungsten x-ray target metal layer. As discussed in detail in the previous paragraph, the stress buffer zone can be configured in a number of ways. Including the stress buffer zone can increases the lifespan of the stationary x-ray target assembly.

Suitable deposition processes for forming the x-ray target metal layer and/or the stress buffer zone include, but are not limited to, electroforming, chemical vapor deposition (CVD), plasma-enhanced chemical vapor deposition (PECVD), physical vapor deposition (PVD), vacuum plasma spray, high velocity oxygen fuel thermal spray, and detonation thermal spraying. These processes can be used to deposit the metals typically used in manufacturing high-performance stationary x-ray target assemblies.

Disclosed metal deposition processes can be readily used to form components using high melting point metals and/or metals that are otherwise difficult to work with using traditional metal working techniques, such as molding, forging, or brazing. The disclosed metal deposition processes can also be readily used to form composites of materials that typically do not form alloys, such as tungsten and copper.

In a disclosed embodiment, the deposition process used to deposit the x-ray target metal layer and/or the stress buffer zone is electroforming. The electroforming process can be used to form an x-ray target metal layer on at least a portion of the substrate to yield an x-ray target assembly.

The electroforming process can be carried out by providing an electoforming apparatus that includes an electroforming chamber, an electrolyte, at least one metal anode, and an electoforming cathode. At least one x-ray target substrate (i.e., at least one intermediate stationary x-ray target assembly) is attached to the electroforming cathode and suspended in the electrolyte. An x-ray target metal layer is electrodeposited onto the substrate by running an electrical current through the metal anode and the electroforming cathode so as to deposit an x-ray target metal layer on the substrate to yield a stationary x-ray target assembly.

Electroforming of high melting point metals can be facilitated by the use of a molten salt electrolyte and high operating temperatures.

The use of electroforming to manufacture x-ray target metal layer and or a stress buffer zone has surprising and unexpected results in the performance of the stationary x-ray target assembly. Stationary x-ray target assemblies manufactured using electroforming have superior properties compared to components typically made by powder or ingot metallurgy coupled with conventional fabrication processes. For example, manufacturing tungsten x-ray target button followed by joining the target button and a copper substrate by forging or brazing often leads to less than perfect bonding between the two materials because of a persistent oxide layer present on the mating surfaces of the two parts. Electroforming leads to superior bonding by preventing the formation of this oxide layer at the bonding surfaces. Moreover, as previously discussed, deposition processes of the present invention allow the formation of a stress buffer zone between the substrate and target such that there is essentially no thermal expansion discontinuity between the substrate and the x-ray target metal layer.

Electroformed components can have substantially 100% density that results in essentially zero or very low porosity. Generation of x-rays with an electron beam produces a great deal of heat that must be efficiently dissipated away from the stationary x-ray target assembly. Heat dissipation away from the stationary x-ray target assembly is facilitated by using metals that are substantially 100% dense and have essentially zero or very low porosity. In addition, the high density coating is essentially 100% pure (i.e., there are no metallic or non-metallic inclusions in the deposited metals), which allows the x-ray target assembly to be operated under more strenuous and thus higher performance conditions (e.g., higher voltage and/or higher current), owing to the defect-free surface.

Another significant advantage of the components manufactured using disclosed electroforming processes is a uniform, columnar microcrystalline structure that the process produces. The crystal grain of the electroformed components is very fine and aligned in the vertical or columnar direction. The columnar microcrystalline structure provides advantages for any component manufactured using the electroforming process due to the high density and high purity.

Another advantage of x-ray target assemblies manufactured according to disclosed electroforming processes is the thickness with which the highly ordered crystal lattice can be grown. A metal layer grown to greater thicknesses can provide excellent bonding to the substrate by way of co-deposition of an alloy or composite metal structure composed of the substrate metal and coating metal. A metal layer grown to increased thicknesses can also provide a rigidity that avoids the situation where the metal layer delaminates, curls up, or spalls.

The above described methods are capable of yielding a stationary x-ray target assembly in which there is substantially no thermal expansion mismatch between the x-ray target substrate and the deposited refractory metal x-ray target metal layer. As discussed above, minimizing the thermal expansion mismatch between the x-ray target metal layer and the substrate leads to better bonding between the components, leading to a surprising and unexpected increase in performance and lifespan of stationary x-ray target assemblies manufactured according to disclosed methods.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

In order that the manner in which the above recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF EMBODIMENTS OF THE INVENTION

I. Introduction

Embodiments of the invention concern stationary x-ray target assemblies that are manufactured using a metal deposition process to form one or more metal layers of the target. The present invention can be carried out on any type of x-ray target that includes metal layers made from high melting point metals, such as, but not limited to, refractory metals. The metal deposition processes of the present invention can be used to manufacture stationary x-ray targets with a unique design and/or improved material properties. In particular, the metal deposition processes can be used to manufacture stationary x-ray targets with a stress buffer zone between the x-ray target metal layer and the substrate. The stress buffer zone improves material properties of the metals and/or the bonding between the x-ray target metal layer and the substrate. Improved bonding between the x-ray target metal layer and the substrate also improves the heat dissipation properties of the stationary x-ray target assembly.

II. X-ray Devices

Figure 1:
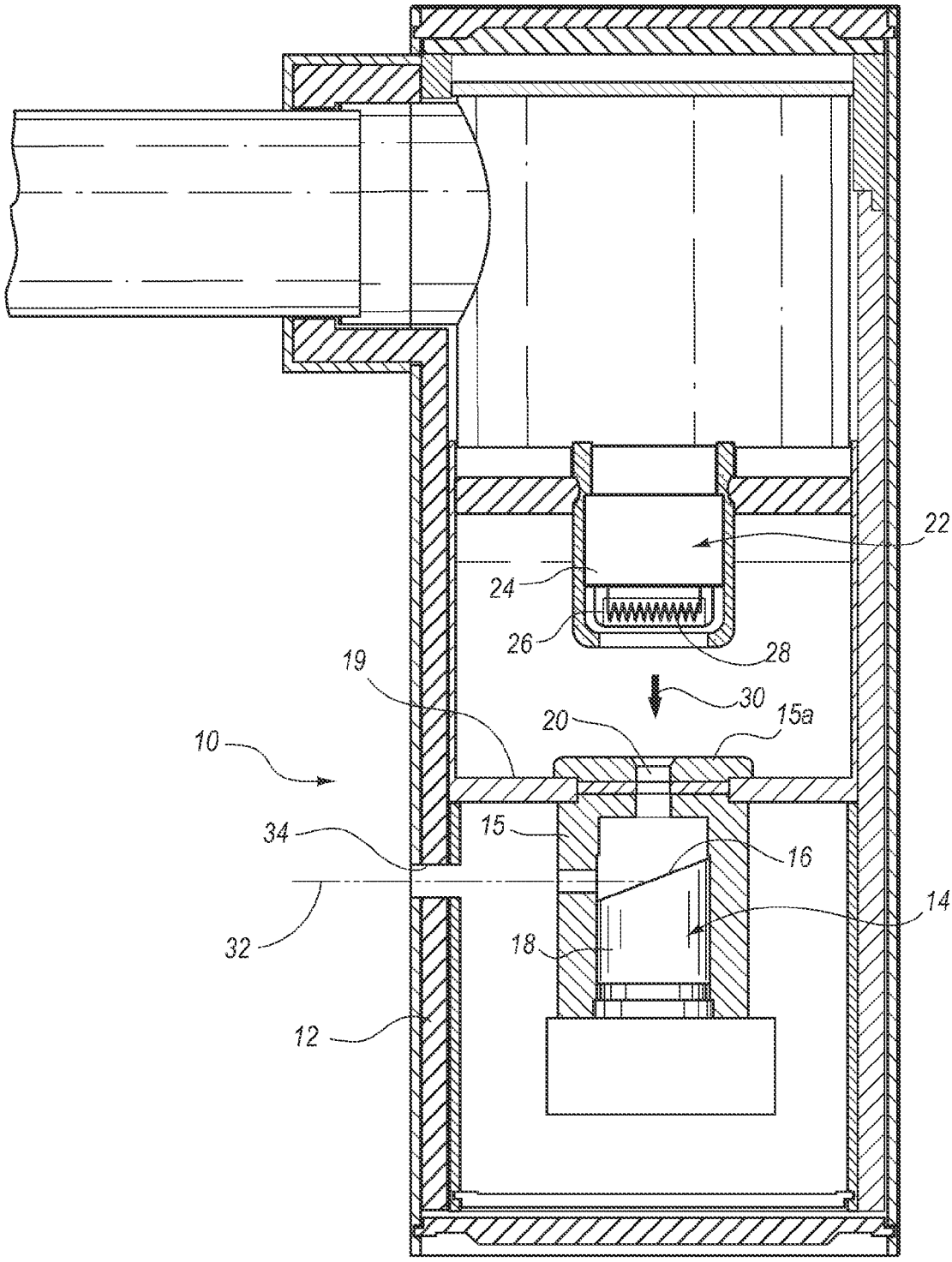
FIG. 1 is a simplified, partial cross sectional view of an x-ray tube with a stationary x-ray target assembly in accordance with one embodiment of the present invention.

Reference is first made to FIG. 1, which depicts one possible environment wherein embodiments of the present invention can be practiced. In particular, FIG. 1 shows a schematic representation of an x-ray tube, designated generally at 10, which serves as one example of an x-ray generating device. The x-ray tube 10 generally includes an evacuated enclosure 12 that houses an x-ray target assembly 14 and a cathode assembly 22. The evacuated enclosure 12 defines and provides the necessary envelope for housing the target assembly 14, the cathode assembly 22, and the other components of the tube 10 while providing the shielding and cooling necessary for proper x-ray tube operation.

The cathode assembly 22 is responsible for supplying a stream of electrons 30 for producing x-rays 32. While other configurations could be used, in the illustrated example the cathode assembly 22 includes a cathode head 24, which includes a filament slot 26 and a filament 28. The filament acts as a source of electrons 30 for x-ray 32 generation. In the depicted embodiment, the filament 28 is shown as a helical coil of wire that is attached to the cathode head 24. The filament 28 and the cathode head 24 are in turn attached to electrical leads (not shown) that provide electrical current to the filament 28 for thermionic emission of electrons 30.

In the example of FIG. 1, some of the emitted electrons 30 that leave the filament 28 strike a cathode aperture shield 15*a*and 19, while many of the remaining electrons 30 pass through an aperture 20 that is positioned between the cathode 22 and the stationary x-ray target assembly 14. The aperture shield 15a and 19 can be cooled by a cooling fluid as part of a tube cooling system (not shown) in order to remove heat that is created in the aperture shield as a result of errant electrons impacting the aperture shield surface.

In the depicted embodiment, the stationary x-ray target assembly 14 is situated in an anode housing 15, disposed within the outer housing 12. The anode housing 15 and the outer housing 12 are hermetically joined as to maintain a vacuum therein. The anode housing 15 is formed of a heat conductive material, such as copper or copper alloy, and houses the stationary x-ray target assembly 14, including a substrate 18 and an x-ray target metal layer 16 disposed atop the substrate.

After the electrons 30 pass through the aperture 20, they strike the x-ray target metal layer 16, where x-rays 32 are produced. The x-ray target metal layer 16 comprises a material having a sufficiently "high" Z number, such as rhodium, palladium, or tungsten, which is suitable for producing x-rays when impinged by electrons. Although it will be appreciated that, depending on the application, other "high" Z materials or composites might be used.

Some of the x-rays 32 that are produced ultimately exit the x-ray tube 10 through an aperture 34 in the outer housing 12 where they can be used for a number of applications.

The production of x-rays described herein can be relatively inefficient. The kinetic energy resulting from the impingement of electrons on the target surface also yields large quantities of heat, which can damage the x-ray tube if not dealt with properly. Excess heat can be removed by way of a number of approaches and techniques. For example, a coolant such as water may be circulated through designated areas of the stationary x-ray target assembly 14 and/or other regions of the tube (see, e.g., FIG. 3). The structure and configuration of the anode assembly can vary from what is described herein while still residing within the claims of the present invention.

One will of course appreciate that FIG. 1 is representative of one example of an environment in which the disclosed embodiments of the present invention might be utilized. However, it will be appreciated that there are many other x-ray tube configurations and environments for which embodiments of the present invention would find use and application.

III. Metal Deposition Process

In disclosed embodiments, x-ray target assemblies are manufactured using a metal deposition process to deposit an x-ray target metal layer and/or a stress buffer zone on a substrate. Possible deposition processes include, but are not limited to, electroforming or electroforming, chemical vapor deposition (CVD), plasma-enhanced chemical vapor deposition (PECVD), physical vapor deposition (PVD), vacuum plasma spray, high velocity oxygen fuel thermal spray, and detonation thermal spraying. These processes can be used to deposit high melting point metals typically used in manufacturing high performance x-ray stationary x-ray target assemblies. In addition, these deposited metals can be substantially 100% dense and free of impurities. Examples of high melting point metals that can be used to coat components of a stationary x-ray target assembly include, but are not limited to Cu, Mo, Ni, Fe, Ta, Re, W, Nb, V, Ir, Rh, Pt, Pd, and combinations thereof.

Figure 2:
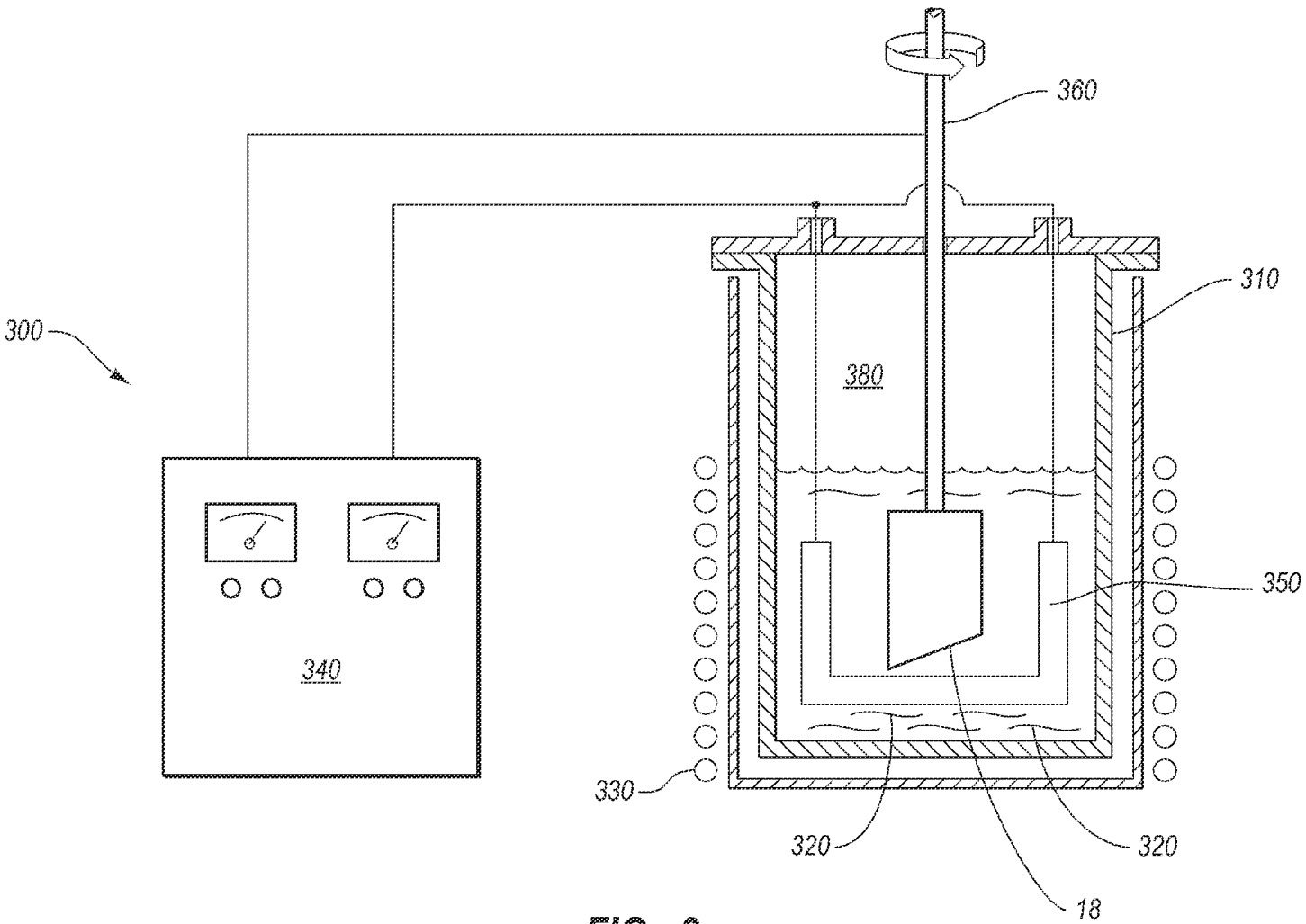
FIG. 2 is a schematic drawing of an electroforming apparatus including an electrolyte, anode, and cathode.

In one example embodiment, the deposition process is electroforming. The electroforming process used to manufacture cathode assemblies is carried out by electrodepositing a metal using an electroforming apparatus. FIG. 2 is a schematic drawing of an electroforming apparatus 300. The electroforming apparatus includes a vessel 310 that holds a liquid electrolyte 320 and an inert atmosphere 380. Vessel 310 can be a graphite material or other material inert to salt at high temperatures. Inert atmosphere can be provided by any inert gas such as nitrogen or argon. A heating element 330 surrounds the vessel 310 and allows the electrolyte to be heated to a desired temperature. Power supply 340 is connected to a positively charged anode 350 and a negatively charged cathode 360. The electroforming anode 350 includes the metal that is to be consumed during electroforming. The metal of anode 350 is submerged in electrolyte 320. The cathode 360 is submerged in the electrolyte and spaced apart from the anode. The cathode 360 provides the surface where the metal from the anode is deposited. In FIG. 2, the portion of the cathode 360 submerged in electrolyte is an x-ray target intermediate 18, which is also referred to herein as a substrate.

Applying a voltage across anode 350 and cathode 360 causes metal to be dissolved in the electrolyte and deposited on the electrically conductive surfaces of the x-ray target substrate 18. Examples of electroforming apparatuses suitable for use with the present invention are devices used with the EL-Form™ process (Plasma Processes, Inc., 4914 Moores Mill road, Huntsville, Ala.; www-plasmapros-com).

The metals deposited using an electroforming process can be any metal suitable for use in manufacturing high performance stationary x-ray targets. The metals used to manufacture high performance x-ray target are typically high melting-point metals having a melting point above about 1650° C. Examples include Mo, Ta, Re, W, Nb, V, Ir, Rh, Pt, and Pd. More preferably, the metal is a refractory metal selected from the group of tungsten, molybdenum, niobium, tantalum, and rhenium. In some embodiments, additional metals may be deposited by the electroforming process to form a composite with the refractory metal. Examples of suitable additional metals include, but are not limited to, Cu, Ni, and Fe. In a one embodiment, copper is deposited along with the refractory metal with copper comprising at least a portion of the electrodeposited layer metal layer.

The metals used for electroforming can be provided in relatively pure form or alternatively they can be scrap metals with various amounts of contaminants. In several embodiments impure metals can be used as the anode metal since the electroforming process selectively deposits only the pure metal. Thus, the electroforming process can use cheaper, impure sources of metal while achieving very high purity electroformed components.

In one embodiment, the electroforming process is carried out until a desired thickness is reached. The time needed to reach a particular thickness depends on the rate of deposition. In one embodiment the deposition rate is in a range from about 5micron/hr to about 80 micron/hr, more preferably in a range from about 25 micron/hr to about 50 micron/hr. The thicknesses of the electroformed component is typically limited by the need for a practical duration. The rate of deposition using the electroforming process can yield thicknesses in a range from about 0.02 mm to about 5 mm, more preferably about 0.75 mm to about 5 mm, even more preferably about 1 mm to about 3.5 mm, and most preferably about 1.25 mm to about 3 mm. In some instances, electrodeposited layers can be grown up to about 8-10 mm thick.

In a disclosed embodiment, the electroforming process is carried out at a relatively high temperature. Heating element 330 is used to control the temperature of the electrolyte 320 during deposition of the metal. Examples of suitable temperatures include temperatures greater than about 500° C., more preferably greater than about 800° C., and up to 1000° C. Electroforming performed at these temperatures reduces internal deposition stresses, which allows relatively thick layers of metal to be formed. In addition, deposition at these higher temperatures gives the metals smaller and more uniform grain sizes. In one embodiment, the microcrystalline structure of the metal deposited at a high temperature is columnar.

The electrolyte used during the deposition process can be any electrolyte capable of acting as a medium to dissolve metal atoms from the anode and transfer the metal atoms to the cathode. In one embodiment, the electrolyte is a molten metal salt. Examples of suitable salts include chlorides or fluorides of sodium or potassium or both. The salt can be made molten by applying heat using heating element 330 of electroforming apparatus 300.

During the metal deposition, the voltage across the anode and the cathode allows the metal atoms to be dissolved in the electrolyte and carried through the electrolyte to the cathode. The negative charge on the surface of the electroforming cathode 360 causes the positively charged metal atoms in the electrolyte to be deposited. Deposition of metal by electroforming occurs anywhere there is negatively charged surface in contact with the electrolyte.

The areas where metal is deposited can be controlled either by selecting a component or components of an x-ray target substrate for coating or by masking a portion of the surface of the x-ray target substrate using a non-conductive material or a conductive, sacrificial material. For example, portions of the x-ray target substrate can be masked with a chemically inert and non-conductive material to avoid coating that portion of the x-ray target substrate. An example of a suitable non-conductive material is a ceramic material such as boronitride or borocarbide. Where a ceramic material is used, relatively lower temperatures can be used to ensure stability of the ceramic material in the electrolyte. Following electroforming, the mask is removed to yield an uncoated surface or surfaces (i.e., uncoated with respect to the material being deposited in that particular deposition step).

In an alternative embodiment, the mask can be a conductive material that is used as a sacrificial mask. In this case the mask can be graphite or another material that is coated during electroforming but the mask can be easily removed so as not to require extensive machining of the x-ray target substrate.

The shape of the negatively charged surface of the cathode determines the shape of the electrodeposited metal layer. The cathode can be made to have almost any desired negatively charged surface. However, to maximize uniformity in the electrodeposited layer it is advantageous to avoid sharp corners and other fine points. In one embodiment, the electrically conductive surface area is provided by an intermediate x-ray target assembly (i.e., an x-ray target substrate).

Alternatively, the electrically conductive cathode surface can be a form that provides a desired shape for making an x-ray target metal layer but is then separated from the x-ray target metal layer. For example, the form can be a carbon block that provides a desired shape for making an x-ray target substrate. The carbon block can then be removed and the electroformed substrate can be incorporated into an x-ray target assembly. Here, the term "electroforming" encompasses both a process where the "mold" or "form" is separated from the deposited metal and a process where the mold or form (e.g. a target substrate) remains attached to the deposited material and therefore becomes part of, for example, the finished x-ray target.

In one embodiment, the electroforming is used to deposit a metal composite or a metal alloy. Using two or more different metals in the electroforming anode results in deposition of both metals. If desired, the concentration of the two or more metals can be varied throughout the deposition process by varying the voltage applied to the two or more metals to yield a layer with a continuously or semi-continuously variable composition (i.e., a graded composition). A graded composition can be used to ensure that certain additional metals are placed closer to a surface or component interface where the additional metal is more important. Alternatively a graded composition can provide a transition layer between two dissimilar layers, thereby improving the bonding between two dissimilar layers and reducing the likelihood of delamination and/or debonding.

The electroformed x-ray target metal layer can be formed so as to have its final desired shape, or alternatively, the electroformed metal layer can be further machined to have the desired shape and dimensions.

In an alternative embodiment, the deposition process is chemical vapor deposition or plasma-enhanced chemical vapor deposition. CVD and PECVD are chemical processes that transform gaseous precursor molecules into a solid material on the surface of a substrate. A variety of metallic films can be grown on surfaces using CVD by starting with a gaseous precursor that contains a desired metal. The gaseous precursor is selectively decomposed at the surface of the substrate leaving a coating of the metal on the surface of the substrate.

By way of example, tungsten metal can be deposited on a surface by starting with tungsten hexafluoride gas. In a typical application the substrate is heated such that the gaseous precursor is decomposed as it flows over the substrate. When the tungsten hexafluoride is decomposed, metallic tungsten is deposited on the substrate leaving gaseous fluorine as a waste product. In an alternative process, the tungsten hexafluoride is mixed with hydrogen gas. In that case, the waste product is hydrogen fluoride gas. Examples of other metals that can be deposited with CVD include but are not limited to Mo, Ni, Ti, and Ta.

PECVD is similar to CVD, except that the deposition reaction is typically facilitated by generating a plasma from the gaseous precursor. Processing plasmas are typically operated at pressures of a few millitorr to a few torr, although arc discharges and inductive plasmas can be ignited at atmospheric pressure. High energy reactions occur in the plasma that cause dissociation of many of the precursor gas molecules and the creation of large quantities of free radicals.

As a result of the "pre-degradation" that occurs in the plasma, materials can be deposited onto a substrate at a much lower substrate temperature than is practical for CVD. This is particularly advantageous when working with tempered metals that would be damaged by the high temperatures necessary for CVD. A second benefit of deposition within a discharge arises from the fact that electrons are more mobile than ions. As a consequence, the plasma is normally more positive than any object it is in contact with, as otherwise a large flux of electrons would flow from the plasma to the object. The voltage between the plasma and the objects it contacts is normally dropped across a thin sheath region. Ionized atoms or molecules that diffuse to the edge of the sheath region feel an electrostatic force and are accelerated towards the neighboring surface. Thus all surfaces exposed to a plasma receive energetic ion bombardment. This bombardment can lead to increases in density of the film, and help remove contaminants, improving the film's electrical and mechanical properties. When a high-density plasma is used, the ion density can be high enough so that significant sputtering of the deposited film occurs; this sputtering can be employed to help planarize the film and fill trenches or holes.

Advantages of CVD and/or PECVD include the fact that the processes can be used to deposit coatings of a wide variety of metals. In addition, the surface that is being coated does not necessarily have to be conductive and the coatings that are applied are substantially 100% dense. Nevertheless, CVD is limited in the thickness of the coatings that can be grown, growth rates of the coatings range in a few microns per hour, and the waste products are often toxic and/or corrosive.

In another alternative embodiment, the deposition process is physical vapor deposition. The PVD process is highly similar to CVD except that the precursor is a solid material that is ionized or evaporated by bombarding the solid with a high energy source such as a beam of electrons or ions. The ionized or evaporated atoms are then transported to a substrate where they are deposited.

Advantages of PVD are similar to CVD. Disadvantages include the fact that PVD is a so-called line of sight technique, meaning that it is extremely difficult to coat undercuts and other complex surface features. Moreover, PVD can be slow, relatively expensive, and the thickness of the coatings is limited to a few microns.

In another alternative embodiment, the deposition process is vacuum plasma spray. The vacuum plasma spray process is basically the spraying of molten or heat softened material onto a surface to provide a coating. Material in the form of powder is injected into a high temperature plasma gun, where it is rapidly heated to form liquid droplets and accelerated to a high velocity. The hot liquid droplets impact on the substrate surface and rapidly cools forming a coating. In theory, vacuum plasma spray can be used to apply a coating of essentially any material that can be powdered and that can survive the plasma stream. For example, coatings of Mo, Ni, Ta, Re, W, Nb, V, Ir, Rh, Pt, Pd, and oxide, nitride, and carbide derivative thereof can be readily applied with vacuum plasma spray.

Vacuum plasma spray has the advantage that it can spray very high melting point materials such as refractory metals and ceramics unlike the combustion processes described below. Disadvantages of the plasma spray process include the fact that coatings are not essentially 100% dense, the coatings often contain impurities (i.e., if the powderized metal contains impurities, the coating will also contain impurities.).

In another alternative embodiment, the deposition process is high velocity oxygen fuel thermal spray ("HVOF"). In an example HVOF process, fuel and oxygen are fed into a chamber where combustion produces a high pressure flame that is fed down a slender tube increasing its velocity. Powdered material for coating (e.g., metal powder) is fed into the flame stream. The flame stream is directed at the substrate to be coated where the hot material impacts on the substrate surface and rapidly cools forming a coating. In theory, HVOF can be used to apply a coating of essentially any material that can be powdered and that can survive the flame stream. For example, coatings of Mo, Ni, Ta, Re, W, Nb, V, Ir, Rh, Pt, Pd, and oxide, nitride, and carbide derivatives thereof can be readily applied with HVOF.

Advantages and disadvantages of HVOF are essentially identical to those listed for vacuum plasma spray.

In another alternative embodiment, the deposition process is detonation thermal spray. A detonation thermal spray apparatus essentially consists of a gun that is used to shoot hot powderized coating material onto a substrate. The detonation gun basically consists of a long water cooled barrel with inlet valves for gases and powder. Oxygen and fuel (e.g., acetylene) are fed into the barrel along with a charge of powder. A spark is used to ignite the gas mixture and the resulting detonation heats and accelerates the powder to supersonic velocity down the barrel. After firing, a pulse of nitrogen is used to purge the barrel and the process is repeated. The high kinetic energy of the hot powder particles on impact with the substrate result in a build up of a very dense and strong coating. In theory, detonation thermal spray can be used to apply a coating of essentially any material that can be powdered and that can survive the firing process. For example, coatings of Mo, Ni, Ta, Re, W, Nb, V, Ir, Rh, Pt, Pd, and oxide, nitride, and carbide derivatives thereof can be readily applied with detonation thermal spray.

Advantages and disadvantages of detonation thermal spray are essentially identical to those listed for plasma spray.

IV. Stationary X-Ray Target Assemblies

Figure 3:
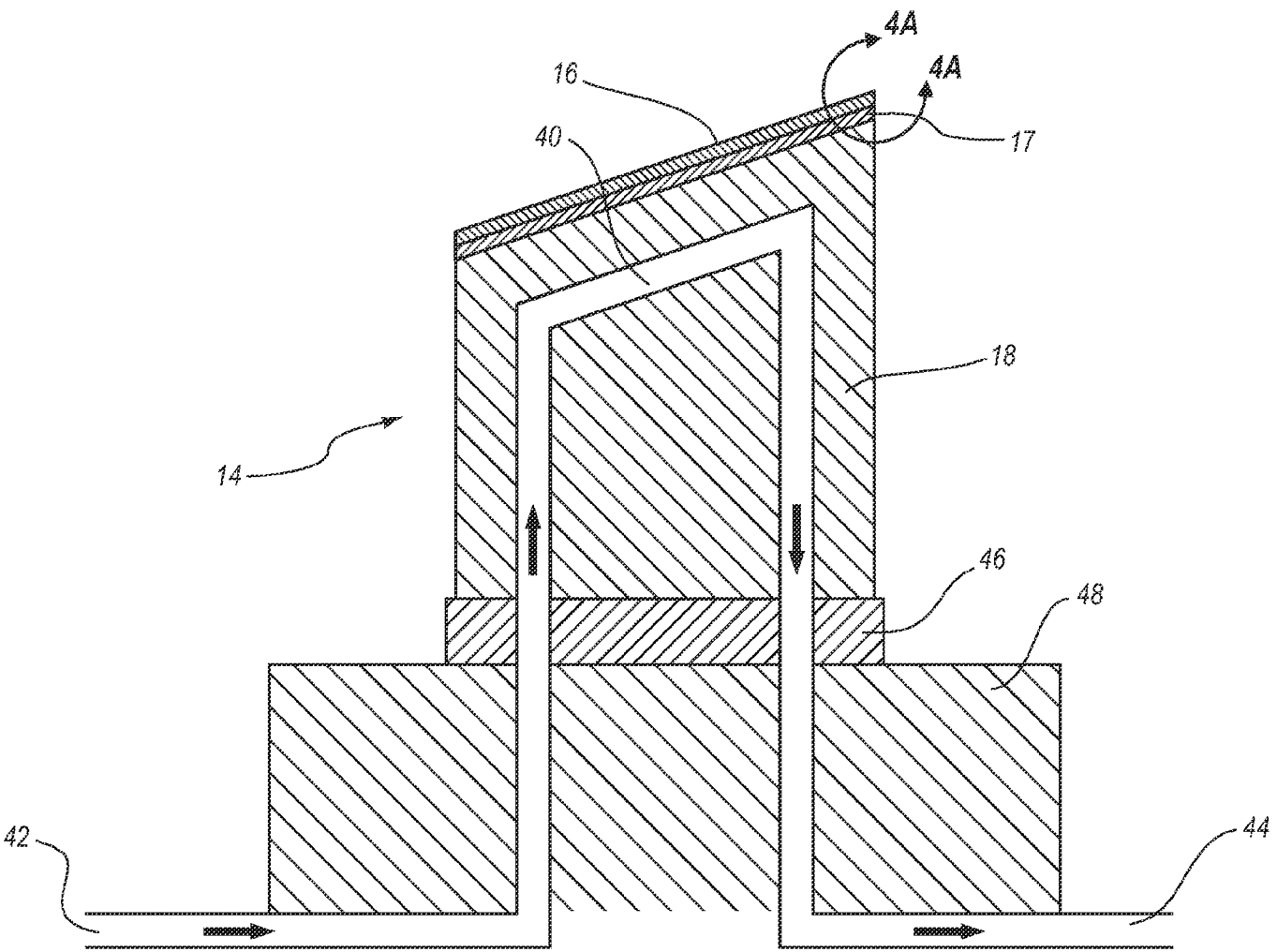
FIG. 3 is a cross-sectional view of a stationary x-ray target assembly according to an embodiment of the invention.
Figure 4B:
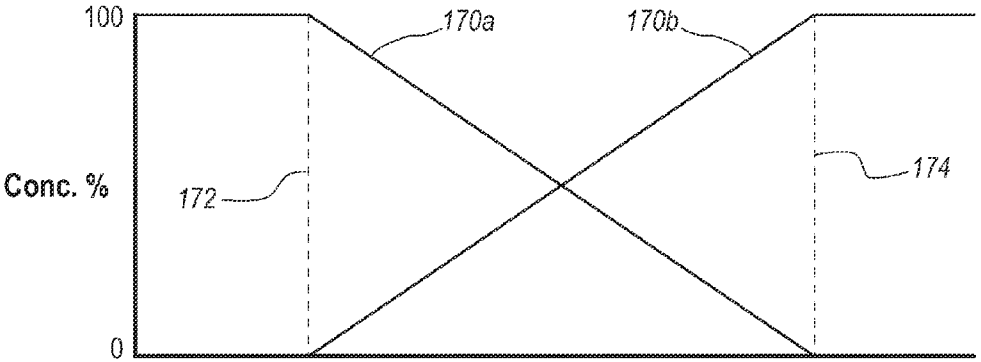
FIG. 4B illustrates example concentration gradients for a stress buffer zone that includes two metals according to one embodiment of the invention.
Figure 4C:
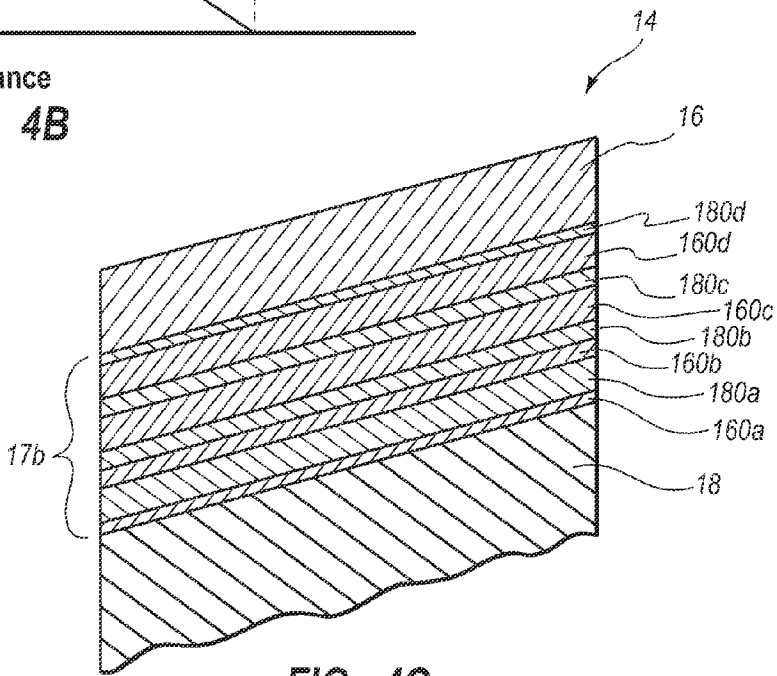
FIG. 4C is a cross-sectional view of a stationary x-ray target assembly showing details of stress buffer zone according to another embodiment of the invention.
Figure 4A:
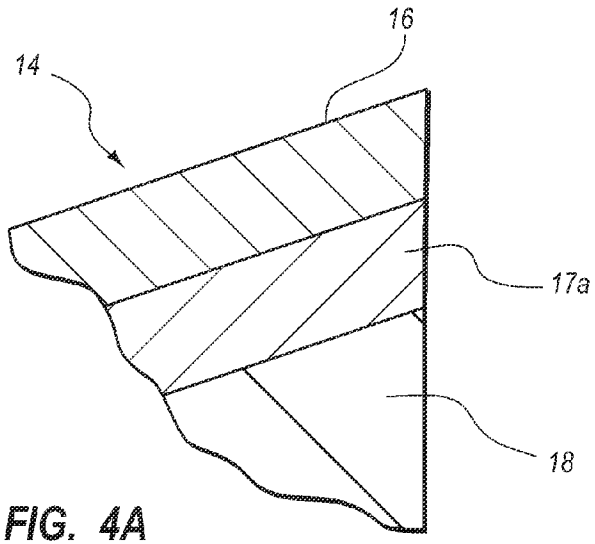
FIG. 4A is a cross-sectional view of a stationary x-ray target assembly showing details of a stress buffer zone according to one embodiment of the invention.

FIGS. 3, 4A, 4B, and 4C depict various features of an x-ray target assembly according to one example embodiment. FIG. 3 illustrates a cross-sectional view of a simplified structure of an example stationary x-ray target assembly 14. The stationary x-ray target assembly 14 includes a substrate 18, an x-ray target metal layer 16, a stress buffer zone 17, a pair of base structures 46 and 48 upon which the target assembly 14 rests, and a cooling coil 40 that includes inward and outward flows of water 42 and 44, respectively. FIGS. 4A and 4C illustrate cross-sectional views detailing the relationship between the x-ray target metal layer 16, the stress buffer zone 17, and the substrate 18.

In the embodiment depicted in FIG. 3, the stationary x-ray target assembly includes an x-ray target metal layer 16 and a stress buffer zone 17 that are formed on the substrate 18 using at least one of the deposition processes and materials described above. The x-ray target metal layer 16 is formed on the upper portion of the substrate 18 from a "high" Z material that is suitable for emitting x-rays upon bombardment by a stream of highly energized electrons. Examples of suitable metals for manufacturing an x-ray target metal layer according to the deposition processes of the present invention include, but are not limited to Cu, Mo, Ni, Fe, Ta, Re, W, Nb, V, Ir, Rh, Pt, and Pd. In a disclosed embodiment, the x-ray target metal layer is composed of tungsten, and optionally includes one or more additional metals, as described above.

In the depicted embodiment the x-ray target metal layer 16 and a stress buffer zone 17 are formed on the end of the substrate 18. In another embodiment (not shown), the x-ray target metal layer 16 and a stress buffer zone 17 may cover the entire outer surface of the substrate 18. The process of determining which portions of the substrate 18 will be coated is dependent at least in part on the metal deposition process being used. In some process, such as plasma spray, the portion (s) of the substrate coated is controlled by directing the portion to be coated toward the stream of material. In other processes, such as electroforming or CVD, the exposed, conductive surface of the substrate 18 will be coated more-or-less equally. Portions where deposited metal is desired are selected by masking a portion of the surface of the x-ray target substrate 18 using a non-conductive material or a conductive, sacrificial material. For example, portions of the x-ray target substrate 18 can be masked with a chemically inert and non-conductive material to avoid coating that portion of the x-ray target substrate 18. An example of a suitable non-conductive material is a ceramic material such as boronitride or borocarbide. Where a ceramic material is used, relatively lower temperatures can be used to ensure stability of the ceramic material in the electrolyte. Following electroforming, the mask is removed to yield an uncoated surface or surfaces (i.e., uncoated with respect to the material being deposited in that particular deposition step).

In an alternative embodiment, the mask can be a conductive material that is used as a sacrificial mask. In this case the mask can be graphite or another material that is coated during electroforming but the mask can be easily removed so as not to require extensive machining of the x-ray target substrate. Alternatively, unwanted material can be machined to remove it from the areas where coating is not desired.

As mentioned previously, the majority of the electrons that impinge on the x-ray target metal layer 16 dissipate their energy in the form of heat, as opposed to dissipating their energy through production of x-rays. This produces a great deal of heat that, among other things, causes the x-ray target assembly 14 to expand. This expansion can be problematic due to the fact that the substrate 18 and the x-ray target metal layer 16 are generally composed of different metals and different metals have different coefficients of thermal expansion. For example, tungsten has a coefficient of linear thermal expansion of approximately $4.3E^{-6}/°$ C., while copper has a coefficient of linear thermal expansion of approximately $16.5E^{-6}/°$ C. This is a significant difference in thermal expansion.

Differential rates of thermal expansion as between the substrate 18 and the x-ray target metal layer 16 can, in some cases, cause the x-ray target metal layer 16 to debond from the substrate 18. In turn, such debonding between the substrate 18 and the x-ray target metal layer 16 can cause the x-ray target assembly 14 to overheat and fail. For example, heat dissipation through the cooling coil 40 depends to a large extent on the thermal conductivity of the substrate material. It follows that heat dissipation from the target metal layer 16 depends to a large extent on intimate contact between the x-ray target metal layer 16 and the substrate 18. If the there is debonding between the substrate 18 and the x-ray target metal layer 16, it reduces the efficiency of heat dissipation through the cooling coil 40, which increases the likelihood of failure of the x-ray target assembly 14.

Maintaining a good bond between the x-ray target metal layer 16 and the substrate 18 is also important in other respects. For example, the water flowing through the cooling coil 40 can cause corrosion of the metal inside the target assembly 14. Such corrosion also reduces the efficiency of the cooling system, which can exacerbate the effect of debonding between the substrate 18 and the x-ray target metal layer 16.

In the depicted example, the x-ray target metal layer 16 is backed by a stress buffer zone 17 that serves to join the substrate 18 to the x-ray target metal layer 16. The stress buffer zone 17 is configured to ameliorate the thermal expansion mismatch that can occur between the substrate 18 to the x-ray target metal layer 16. Ameliorating thermal expansion mismatch helps to maintain good bonding between the between the x-ray target metal layer 16 and the substrate 18. FIGS. 4A and 4C illustrate various details of the stress buffer zone 17.

In FIGS. 4A and 4C, depict two related embodiment of the stress buffer zone 17. In FIG. 4A, the stress buffer zone 17*a* is made up of one or more metals that are selected to ameliorate the thermal expansion mismatch that can occur between the substrate 18 to the x-ray target metal layer 16. In a related embodiment, the stress buffer zone 17*a* is comprised of composite of two or more metals in which the two or more metals are intimately mixed to form a metal composite or a metal alloy. In yet another embodiment, the composite may be a graded composite in which the relative concentrations of the two or more metals are varied across the thickness of the stress buffer zone 17.

In one embodiment, the stress buffer zone is a graded composite of the metals that make up the substrate 18 and the x-ray target metal layer 16. In particular, the concentration of the substrate metal 170*a* in the stress buffer zone 17*a* approaches 100% at the interface between the substrate 18 and the stress buffer zone 17*a*, and the concentration of the substrate metal 170*a*in the stress buffer zone 17*a* approaches 0% at the interface between the x-ray target metal layer 16 and the stress buffer zone 17*a*. One will of course appreciate that while the concentration of the substrate metal is being reduced, the concentration of the metal that forms the x-ray target metal layer is being increased.

FIG. 4B graphically illustrates the concentration gradients that may be seen in a stress buffer zone that includes two metals. As can be seen from FIG. 4B, the concentration of the substrate metal is essentially 100% at the boundary 172 between the substrate and the stress buffer zone. As can also be seen, the concentration of the metal 170*b* used to form the x-ray target metal layer 16 is essentially 0% at boundary 172. Moving across the distance, the concentration of metal 170*a* gradually decreases while the concentration of metal 170*b* gradually increases. At the boundary 174 between the stress buffer zone and the x-ray target metal layer, the concentration of metal 170*b* is essentially 100% while the concentration of metal 170*a* is essentially 0%. One will of course appreciate that the concentration gradients depicted in FIG. 4B is merely illustrative and that other concentration gradients can be used without departing from the spirit or the scope of the present invention.

FIG. 4C illustrates another example of a stress buffer zone 17*b*. In the embodiment depicted in FIG. 4C, the stress buffer zone 17*b* consists of alternating layers of two or more metals (160*a*-160*d* and 180*a*-180*d*). In an example embodiment, the metal layers 160*a*-160*d*and 180*a*-180*d* consist of the alternating layers of the materials that form the substrate 18 and the x-ray target metal layer 16. In particular, FIG. 4C depicts an embodiment of the present invention in which the alternating layers 160*a*-160*d* and 180*a*-180*d* are made with varying thicknesses such that the layers composed of target material 160*a*-160*d* become progressively thicker towards the x-ray target metal layer 16, while the layers of the substrate material 180*a*-180*d* are thickest near the substrate 18 and they become progressively thinner toward the x-ray target metal layer 16.

One will appreciate that forming a stress buffer zone such as depicted in FIGS. 4A and 4C essentially eliminates the thermal expansion mismatch between the substrate 18 and the x-ray target metal layer 16. One will also appreciate based on the foregoing discussion that elimination of the thermal expansion mismatch between the substrate 18 and the x-ray target metal layer 16 substantially improves the performance and lifespan of the stationary x-ray target assembly 14. For example, such a stationary x-ray target assembly 14 can generally be operated at a higher voltage and with higher electron beam flux because the cooling is more efficient. Moreover, the stationary x-ray target assembly 14 will have a longer lifespan because there will be less likelihood of delamination or debonding between the substrate 18 and the x-ray target metal layer 16.

The disclosed embodiments are to be considered in all respects only as exemplary and not restrictive. The scope of the invention is, therefore, indicated by the appended claims rather than by the foregoing disclosure. All changes which come within the meaning and range of equivalency of the claims are to be embraced within their scope.

What is claimed is:

1. A method for manufacturing a stationary x-ray target assembly, the method comprising:

providing an intermediate x-ray target assembly comprising a substrate; and forming an x-ray target metal layer on at least a portion of the substrate using a electroforming process to yield a stationary x-ray target assembly, wherein the x-ray target metal layer is comprised of at least one refractory metal suitable for generating x-rays upon impingement of a stream of electrons.

2. A method as in claim 1, wherein the substrate is comprised of a material chosen from a group consisting of Cu, Mo, Ni, Fe, Ta, Re, W, Nb, V, Ir, Rh, Pt, Pd, stainless steel, and combinations thereof.

3. A method as in claim 1, wherein the deposited x-ray target metal layer is comprised of one or more metals selected from the group consisting of Cu, Mo, Ni, Fe, Ta, Re, W, Nb, V, Ir, Rh, Pt, and Pd.

4. A method as in claim 1, further comprising forming a buffer zone between the substrate and the x-ray target metal layer using an electroforming process, the buffer zone being comprised of one or more metals.

5. A method as in claim 4, wherein the buffer zone comprises a graded composite or a graded alloy of two or more metals.

6. A method as in claim 4, wherein the buffer zone comprises alternating layers of two or more metals.

7. A method as in claim 1, wherein the stationary x-ray target assembly is comprised of copper and tungsten, and wherein the substrate is comprised primarily of copper, the x-ray target metal layer is comprised primarily of tungsten, and including a buffer zone electroformed between the substrate and the x-ray target metal layer that is comprised of a composite of copper and tungsten, with the copper content being varied through at least a portion of the buffer zone.

8. A method for manufacturing a stationary x-ray target assembly using an electroforming process, comprising:

providing an electroforming apparatus, an electrolyte, a metal anode comprising a metal, and an electrically conductive cathode, the electrically conductive cathode comprised of at least one electrically conductive intermediate x-ray target assembly; and forming a metal layer on at least a portion of the intermediate x-ray target assembly by electroforming of at least a portion of the metal from the anode onto the electrically conductive intermediate x-ray target assembly so as to yield a stationary x-ray target assembly, wherein the metal layer is suitable for generating x-rays upon impingement of a stream of electrons on the stationary x-ray target assembly.

9. A method as in claim 8, wherein the electrically conductive intermediate x-ray target assembly comprises one or more metals selected from the group consisting of Cu, Mo, Ni, Fe, Ta, Re, W, Nb, V, Ir, Rh, Pt, Pd, C, stainless steel, and combinations thereof.

10. A method as in claim 8, wherein the metal anode of the electroforming apparatus comprises one or more metals selected from the group consisting of Cu, Mo, Ni, Fe, Ta, Re, W, Nb, V, Ir, Rh, Pt, and Pd.

11. A method as in claim 8, further comprising electrodepositing a buffer zone between the intermediate x-ray target assembly and the metal layer by for coupling the intermediate x-ray target assembly to the metal layer.

12. A method as in claim 11, wherein the metal anode comprises two or more metals and the buffer zone comprises a metal alloy or a metal composite.

13. A method as in claim 12, wherein the metal alloy or the metal composite is graded.

14. A method as in claim 11, wherein the metal anode comprises two or more metals and the buffer zone comprises alternating layers of the two or more metals.

15. A method as in claim 8, wherein the electrolyte is a molten salt.

16. A method as in claim 8, wherein the electroforming is carried out at a temperature greater than about 500 ° C.

17. An x-ray target assembly manufactured according to the method of claim 1, thereby yielding an x-ray target assembly wherein the x-ray target metal layer has a substantially columnar microcrystalline structure and substantially 100% density.

18. An x-ray target assembly as in claim 17, wherein the x-ray target metal layer has a thickness of at least 1.0 mm.

19. A stationary x-ray target assembly, comprising:

an x-ray target substrate comprising a first metal;

an x-ray target metal layer suitable for generating x-rays upon impingement of a stream of electrons comprising a refractory second metal; and a buffer zone situated between the x-ray target substrate and the x-ray target metal layer, the buffer zone comprising a layered structure with alternating layers of the first and second metals, wherein the layered structure has layers of the second metal that gradually increase in thickness while simultaneously having layers of the first metal that gradually decrease in thickness.

20. A stationary x-ray target assembly as in claim 19, wherein the buffer zone has thickness in a range from about 0.2 mm to about 3 mm.

21. A stationary x-ray target assembly as in claim 19, wherein the buffer zone provides for substantially no thermal expansion mismatch between the x-ray target substrate and the x-ray target metal layer.

* * * * *